United States Patent [19]

McLeod, Jr.

[11] Patent Number: 4,695,264

[45] Date of Patent: Sep. 22, 1987

[54] CONVERTIBLE STUFFED FIGURE

[76] Inventor: Marvin K. McLeod, Jr., Rte. 1, Box 201A, Valley, Wash. 99181

[21] Appl. No.: 879,570

[22] Filed: Jun. 27, 1986

[51] Int. Cl.[4] ..... A63H 3/00

[52] U.S. Cl. ..... 446/321; 446/369

[58] Field of Search ..... 446/74, 321, 369

[56] References Cited

U.S. PATENT DOCUMENTS

| | | | |
|---|---|---|---|
| 1,549,035 | 8/1925 | Van Laar . | |
| 2,325,750 | 8/1943 | De Vries | 446/321 |
| 4,336,665 | 6/1982 | Moreau . | |
| 4,413,442 | 11/1983 | McSweeney . | |
| 4,563,159 | 1/1986 | Hills . | |
| 4,614,505 | 9/1986 | Schneider et al. | 446/321 |

*Primary Examiner*—Kenneth J. Dorner

*Assistant Examiner*—James R. Brittain

*Attorney, Agent, or Firm*—Wells, St. John & Roberts

[57] ABSTRACT

A toy is disclosed including two interconnected, eversible figures. The two figures are joined to one another and include separate internal cavities, each having a capacity to hold or contain the other figure. The figures are joined to one another along a common opening and at a point preferably opposite the common openings. As one figure is folded outwardly through the opening, the other figure is progressively eversed and drawn through the opening and into the internal chamber of the figure currently being folded outward. The figure thus being folded outward is progressively stuffed by the figure being everted and folded inwardly into the cavity of the outward folding figure.

20 Claims, 5 Drawing Figures

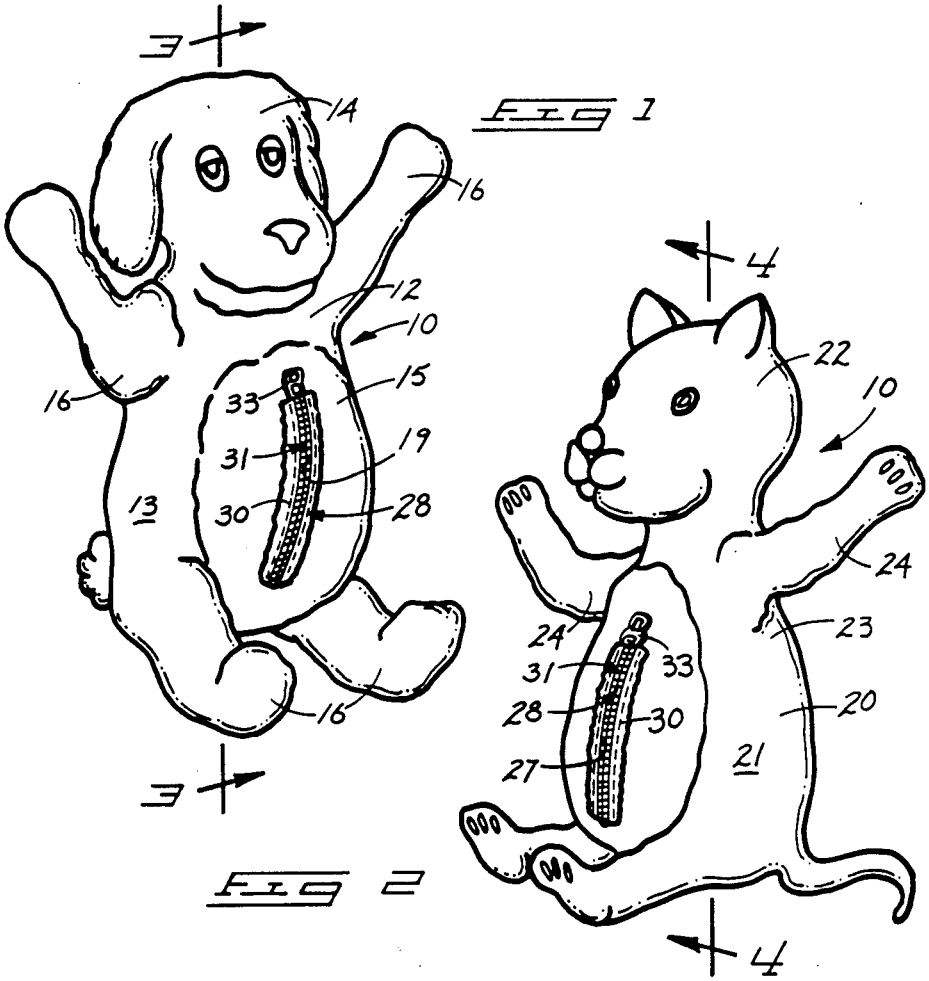
FIG 1
FIG 2
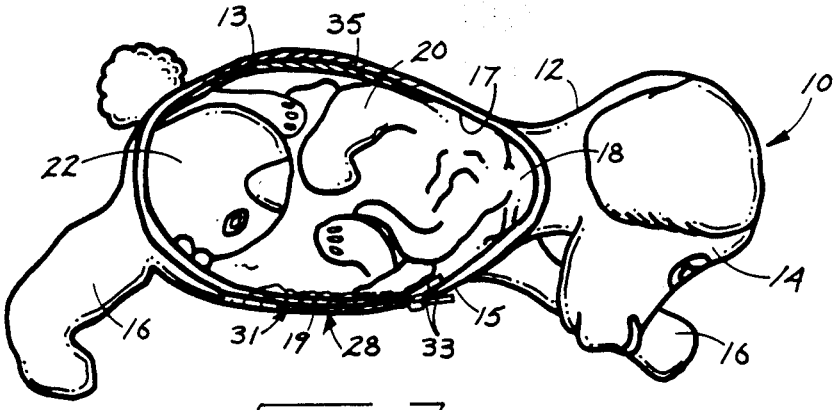
FIG 3

CONVERTIBLE STUFFED FIGURE

TECHNICAL FIELD

The present invention relates to eversible stuffed toys wherein either one of two figures may be everted, and received as stuffing within a cavity of the other.

BACKGROUND OF THE INVENTION

The typical stuffed toy has an external surface shaped in the form of a three dimensional object or figure. Internal stuffing lends the figure its particular shape and a certain amount of resiliency or softness. Stuffed toys have emotional appeal, due to the usual softness and the appearance of the toy.

A single stuffed toy though will lose its appeal after time, typically due to familiarity with the features of the toy. But after the toy is absent for a while, interest and affection is usually renewed. An obvious solution to maintain interest and avoid boredom is to provide multiple toys so another toy can be substituted for one that has temporarily lost its appeal. This solution may lead to considerable expense. Furthermore, storage becomes a problem with the increased number of toys required to maintain peak interest.

It is desirable for any toy to stimulate the imagination. "Convertible" toys have been developed that accomplish this result. However, the features that enable conversion are often unappealing themselves and distract from the outward appearance of the toy.

U.S. Pat. No. 4,563,159, for example, discloses what appears to be a "teddy bear" and a tote bag, sewn together in such a manner that the bear can be stuffed partly or completely into the tote bag. Conversely, the tote bag can be stuffed into the bear. The two figures are also interconnected in such a manner that both figures can be entirely exposed, with the bear and the tote bag being fully exposed to the view of the user. Yet, each figure has a hollow interior to receive the other figure. The result when both figures are exposed is a misshaped arrangement in which neither figure is exposed to the best aesthetic advantage. The two figures are constructed separately yet connected in such a manner that the bear can be stuffed into and encased within the tote bag. The bear is likewise hollow so the tote bag can be stuffed into the internal cavity of the bear.

Neither of the figures are interconnected other than at the common opening between the two internal cavities, so both figures can be entirely exposed as indicated above. This can cause confusion, especially in younger children, as to how the separated figures are to be assembled to form only one or the other.

U.S. Pat. No. 4,413,442 discloses a transformable toy. This toy transforms from an egg configuration to a goose configuration. Transformation is not complete reversal since a portion of the egg configuration remains in both forms of the toy.

U.S. Pat. No. 4,336,665 discloses a convertible stuffed toy comprised of two oppositely facing heads and a reversible cover section between the heads that can be folded over one head to expose the other. There is no body or torso between the heads, nor does one head receive the other within an internal cavity to complete a full transformation of the figures. Instead, the cover is folded to one side or the other to simply cover one of the head sections, leaving the other exposed.

U.S. Pat. No. 1,549,035 discloses a doll that can be folded to form a carrying case in a manner somewhat similar to U.S. Pat. No. 4,563,159 disclosed above. No "eversion" takes place however since the doll is simply folded into another configuration. A substantial portion of the doll remains exposed.

Of the above references, none disclose a toy that can be easily and quickly everted such that one figure is completely drawn into and contained within the other, hidden from view while the other figure is completely exposed. Furthermore, none of the references disclose features that will guide the user in the eversion process so that as the user draws one figure outwardly to be exposed, the other figure is automatically drawn into the figure being exposed. Instead, the prior references show figures in which only partial transformations are made or in which one figure must be completely exposed before the other can be stuffed into an internal void of the exposed figure.

BRIEF DESCRIPTION OF THE DRAWINGS

The preferred embodiment of the invention is illustrated in the accompanying drawings, in which:

FIG. 1 is a perspective view of an exemplary external surface of a first figure in the present toy;

FIG. 2 is an exemplary view of a second figure of the present toy;

FIG. 3 is a sectional view taken substantially along line 3—3 in FIG. 1;

DETAILED DESCRIPTION OF THE PREFERRED EMBODIMENT

Figure 4:
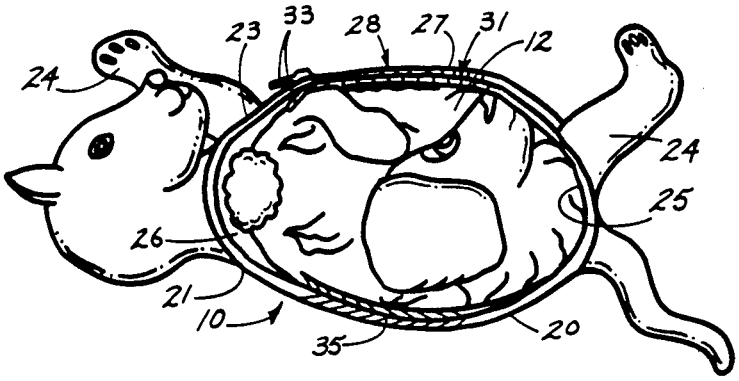
FIG. 4 is a sectional view taken substantially along line 4—4 in FIG. 2.

In compliance with the constitutional purpose of the Patent Laws "to promote the progress of science and useful arts" (Article 1, Section 8), applicant submits the following disclosure of the invention.

The present invention is embodied in an eversible toy which is generally designated in the drawings by the reference numeral 10. The toy 10 includes a first object or FIG. 12 which, in the example shown is in the form of a dog. Toy 10 also includes a second object or FIG. 20 (FIGS. 2 and 4) in the form of a cat.

It should be well understood that the dog and cat shown in the drawings are merely exemplary of a first and second FIG. 12, 20 and that other figures can be readily envisioned. In fact, it may be desirable to use figure configurations of related or opposing characters. For example, one figure might be a lion and the other figure a lamb.

The features of each figure can be totally independent of the other so the nature of the figures is limited only by the pattern maker's imagination. The only requirement is that the two figures be substantially proportionate, since one figure must become the stuffing for the other. Therefore, if an elephant and a mouse are selected as figures, the patterns would be made such that the mouse figure would be substantially equal in size to the elephant figure.

Referring in more detail to FIGS. 1 and 3, the first object or FIG. 12 is shown including a shaped external surface 13. As discussed above, this external surface 13 can take substantially any configuration desired. In the example shown, the first object or FIG. 12 includes a head 14, a torso 15 and limbs 16.

A portion of the first FIG. 12, such as the torso 15, includes an internal surface 17 defining a cavity 18. An opening 19 is provided for access to the internal cavity 18.

The second object or FIG. 20 is shown generally in FIGS. 2 and 4. It includes a shaped external surface 21 that may also be provided in any desired form. In the example shown, the FIG. 20 includes a head 22, a torso 23, and limbs 24. The torso 23 may include an internal surface 25 that defines an internal cavity 26. The cavity 26 is accessed through an opening 27.

The FIGS. 12, 20 are joined together in such a manner that the opening 19, 27 are situated in alignment, forming a single interface opening 28 that is common to both cavities 18 and 26.

The internal surfaces 17, 25 of the FIGS. 12, 20 may be joined along the aligned openings by a seam 30 (FIGS. 1, 2) that extends about the two aligned openings. The seam 30 may also secure a closure means 31 to the figures.

Closure means 31 is provided to selectively open and close the interface opening 28. Closure means 31 may be provided in the form of a double acting zipper having oppositely projecting pull tabs 33, one for each figure. The zipper is arranged so one of the pull tabs 33 will be exposed for access at all times.

An important aspect of the present invention is a means 35 for joining the first and second figures at one or more points thereon apart from the opening 28. Means 35 causes eversion of one figure as the other is folded outward to expose its external configuration. This process is shown being initiated in FIG. 5 of the drawings.

Means may be provided in the form of a seam 35 formed by sewing, glue, etc. It is preferred that the seam 35 be situated along the joined internal surfaces 17, 25 of the figures opposite the opening 28. By doing this, one figure will be progressively everted and pulled into the cavity of the other as the other figure is progressively folded outwardly. The result of the eversion process is shown in FIGS. 3 and 4. One of the figures is everted within the cavity of the other, thus becoming the stuffing for the other figure.

It is important to note the manner by which the figures are connected to control progressive filling of the cavities during the transformation process. The torso, in the case of the dog and cat examples, are joined together one to another along the internal surfaces 17, 25. The seams 30 and 35 join internal surfaces 17 and 25 such that when one figure is exposed, the other is everted, at least to the extent of its torso section. With the seam connection 35, as one figure is turned outwardly, the other figure is simultaneously everted and pulled into the cavity of the outwardly turning figure. The two figures cannot be separated from one another. This avoids confusion and alsoavoids simultaneous exposure of the two figures. Instead, as transformation occurs, one figure moves progressively into the other by the eversion process and the figure being folded outwardly seems to magically transform into a complete, stuffed toy.

It is also important to note that the position of the closure and interface opening 28 can be situated at any convenient location on the surfaces of the two figures. Placement of the opening is selected to facilitate the folding and eversion process. The relationship of the opening 28 and seam 35 may vary according to design. It is preferred, however, that the seam be situated opposite the opening so the eversion process of one figure will occur substantially simultaneously with the other figure being folded outwardly.

Figure 5:
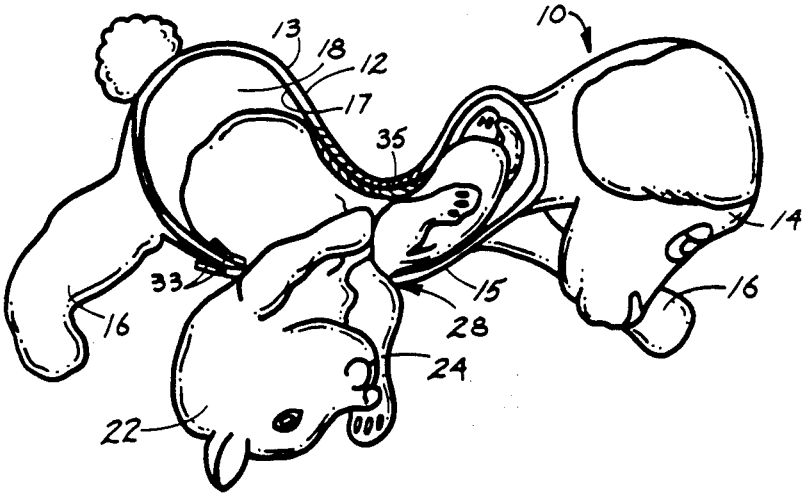
FIG. 5 is an operational view showing an intermediate stage in which eversion of one figure is occurring as the other is being exposed.

To operate the present toy to transform from one figure to another, one simply disengages the closure means. This may be done simply by grasping an exposed zipper tab 33 and pulling downwardly. The opened interface 28 will enable access to the everted figure held inside. In the example shown in FIGS. 3 and 5, the transformation process may continue by pulling or otherwise forcing the cat figure outwardly through the interface opening 28. The seam 35 interconnects both figures and will simultaneously begin to pull or evert the dog figure inwardly as shown in FIG. 5.

When the cat has been fully folded outwardly through the opening, a considerable amount of the dog figure will have been pulled into and everted within the cavity 26 of the cat. Reception of the dog within the cavity 26 of the cat will be complete as the user tucks the dog's head and limbs into the cavity through the opening 28. The presently exposed zipper tab 33 can then be grasped and the zipper closed to complete the transformation process to the configuration shown in FIGS. 2 and 4. The same steps above may be repeated to transform the cat to the dog.

The transformation process is assisted somewhat by the orientation of the two figures. The heads 14, 22, for example, may be located at opposite ends of the torsos 15, 23. This orientation facilitates transformation, at least in the example of a dog and cat configuration shown. Also, each head is best oriented to lend the most authentic shape when received within the torso of the other figure.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A toy including interconnected eversible figures, comprising:

a first complete foldable figure having a shaped external surface and an internal surface surrounding a first internal cavity;

a second complete foldable figure having a shaped external surface independent of the external surface of the first foldable figure and an internal surface surrounding an individual second internal cavity;

wherein the individual external surfaces of the first and second foldable figures are joined together along a common seam;

wherein the common seam defines an opening common to the individual first and second internal cavities of both figures; and means joining the internal surfaces of the first and second figures at a common location along the internal surfaces opposite the opening and distinct from the common seam for eversing one figure into the internal cavity of the other figure as the other figure is folded outward of the one figure to expose the shaped external surface thereof and such that the one figure progressively fills the internal cavity of the other figure to function as stuffing for the other figure.

2. The toy including interconnected eversible figures as claimed by claim 1, further comprising:

double acting closure means along the seam and on opposite sides of the opening accessible with either first or second foldable figures exposed, for selectively opening and closing the opening.

3. The toy including interconnected eversible figures as claimed by claim 2 wherein the figures include head sections and torso sections with the internal cavities formed in the torso sections.

4. The toy including interconnected eversible figures as claimed by claim 3 wherein the heads are at opposite ends of the torso sections.

5. The toy including interconnected eversible figures as claimed by claim 1 wherein the figures include head sections and torso sections with the internal cavities formed in the torso sections.

6. The toy including interconnected eversible figures as claimed by claim 5 wherein the torso sections are joined along the seam between ends of the torso sections; and wherein the heads are at opposite ends of the torso sections.

7. The toy including interconnected eversible figures of claim 6 further comprising double acting zipper closure means along the seam having double pull tabs associated with each figure such that one pull tab is exposed for access at all times.

8. The toy including interconnected eversible figures of claim 7 wherein the figures include elongated torso sections containing the internal cavities and wherein zipper means is elongated and is oriented longitudinally along the torso sections.

9. The toy including eversible figures of claim 8 wherein the figures are joined together by the seam along the zipper means and by the said means in such a manner that one of the external surfaces will face outwardly while the external surface of the other figure is everted and faces inwardly, lining the internal cavity of the currently outwardly exposed figure.

10. A stuffed toy comprising:

a first complete foldable figure having a shaped external surface surrounding an internal cavity;

a second complete foldable figure having a shaped external surface surrounding an internal cavity;

wherein the external surfaces and internal cavities of the first and second figures are discrete and independent of one another;

seam means for joining the external surfaces of the first and second figures about an interface opening common to the two internal cavities; and means connecting the figures together at a location spaced from the interface opening and distinct from the seam means for everting the external surface of the first figure into the cavity of the second figure as the external surface of the second figure is everted outwardly to expose the external surface thereof, the first figure thus becoming the internal stuffing for the second figure, and for likewise everting the external surface of the second figure into the cavity of the first figure as the first figure is everted outwardly to expose the external surface thereof, the second figure thus becoming the internal stuffing within the internal cavity of the first figure.

11. The stuffed toy of claim 10 further comprising closure means for opening and closing the interface opening.

12. The stuffed toy of claim 10 wherein the figures each include a head end and wherein the head end of the first figure is opposite from the head end of the second figure.

13. The stuffed toy of claim 12 wherein the figures are joined together in such a manner that the external surfaces of both figures are joined by the seam means along the interface opening in such a manner that while one of the external surface faces outwardly the other external surface is everted and faces inwardly, lining the internal cavity of the currently outwardly exposed figure.

14. The stuffed toy of claim 13 wherein the figures each include a head end and wherein the head end of the first figure is opposite from the head end of the second figure.

15. The eversible toy of claim 10 wherein the seam means connecting the figures is situated opposite the interface opening.

16. An eversible toy, comprising:

a first complete figure formed of foldable material and having an external surface shaped in the form of a first object and an internal surface defining an internal cavity;

a first opening formed between the external and internal surfaces of the first figure;

a second complete figure formed of foldable material and having an external surface shaped in the form of a second object and an internal surface independent of the internal surface of the first figure and defining an internal cavity independent of the internal cavity of the first figure;

a second opening formed between the external and internal surfaces of the second figure;

wherein the independent internal surfaces of the first and second figures are joined together with the openings thereof aligned by a seam extending alongside the aligned openings; and means interconnecting the internal surfaces of the figures along areas thereon spaced opposite the joined openings and distinct from the seam for everting one figure into the other as the other figure is turned outwardly.

17. The eversible toy of claim 16 wherein the means interconnecting the internal surfaces of the figures is located opposite the aligned openings.

18. The eversible toy of claim 17 further comprising:

closure means along the aligned openings for selectively closing the openings.

19. The eversible toy of claim 16 wherein the objects have heads and torsos;

wherein the torsos include the internal cavities; and wherein the heads are situated at opposite ends of the torsos.

20. The eversible toy of claim 16 further comprising a double acting zipper means joining the aligned openings for selectively opening and closing the openings.

* * * * *